US011473292B2

(12) United States Patent
Brezan et al.

(10) Patent No.: US 11,473,292 B2
(45) Date of Patent: Oct. 18, 2022

(54) EXPANDABLE CONTAINER SHELTER

(71) Applicant: ZEPELIN, S.R.O., Trenčín (SK)

(72) Inventors: Juraj Brezan, Trenčín (SK); Henrich Hodák, Trenčín (SK); Pavol Ochodnický, Trenčín (SK)

(73) Assignee: ZEPELIN, S.R.O., Trencin (SK)

( * ) Notice: Subject to any disclaimer, the term of this patent is extended or adjusted under 35 U.S.C. 154(b) by 0 days.

(21) Appl. No.: 16/626,986

(22) PCT Filed: Jun. 26, 2018

(86) PCT No.: PCT/SK2018/050009
§ 371 (c)(1),
(2) Date: Dec. 27, 2019

(87) PCT Pub. No.: WO2019/004948
PCT Pub. Date: Jan. 3, 2019

(65) Prior Publication Data

US 2020/0224406 A1 Jul. 16, 2020

(30) Foreign Application Priority Data

Jun. 27, 2017 (SK) ..... 50059-2017 U

(51) Int. Cl.
*E04B 1/344* (2006.01)
*E04H 1/12* (2006.01)
(Continued)

(52) U.S. Cl.
CPC ..... *E04B 1/3444* (2013.01); *E04B 1/34336* (2013.01); *E04B 7/022* (2013.01);
(Continued)

(58) Field of Classification Search
CPC ..... E04B 1/3444; E04B 1/34336; E04B 1/34357; E04B 1/34384; E04B 1/3442;
(Continued)

(56) References Cited

U.S. PATENT DOCUMENTS 4,534,141 A * 8/1985 Fagnoni ..... E04B 1/3444 52/68
5,596,844 A * 1/1997 Kalinowski ..... E04B 1/3442 52/122.1
(Continued)

FOREIGN PATENT DOCUMENTS

DE 2620689 B1 10/1977
FR 2634184 A1 * 1/1990 ..... E04B 1/34305
(Continued)

OTHER PUBLICATIONS

Zepelin, S.R.O.; International Patent Application No. PCT/SK2018/050009; International Search Report; dated Feb. 21, 2019; (2 pages).

*Primary Examiner* — Kyle J. Walraed-Sullivan
(74) *Attorney, Agent, or Firm* — Dority & Manning, P.A.

(57) ABSTRACT

Expandable container shelter, where the container comprises elements pivotally connected to the container in vertical mounts at the ends of longitudinal side of the container, provided for creating a structure designed for extending the inner space of the container to a shelter connected with this container at the longitudinal side of the container characterized in that elements provided for creating the structure designed for extending the inner space of the container (1) to the shelter (2) connected with this container (1) are at least on one longitudinal side of the container (1) composed of one pair of supporting frames (3), where the supporting frame (3) comprises at least one horizontal beam (31), wherein the supporting frame (31) has length in the range up to dimension equal to inner length of the container (1), where the shelter (2) roof (6) supports (5) are connected to the supporting frames (3).

18 Claims, 14 Drawing Sheets

(51) Int. Cl.
*E04B 1/343* (2006.01)
*E04B 7/02* (2006.01)
*E04H 3/08* (2006.01)

(52) U.S. Cl.
CPC .. *E04H 1/1205* (2013.01); *E04B 2001/34389* (2013.01); *E04H 3/08* (2013.01); *E04H 2001/1283* (2013.01)

(58) Field of Classification Search
CPC ..... E04B 7/022; E04B 2001/34389; E04B 2001/1283; E04B 7/107; E04B 2002/8694; E04H 1/1205; E04H 15/20
USPC ..... 52/79.5
See application file for complete search history.

(56) References Cited

U.S. PATENT DOCUMENTS 5,966,956 A * 10/1999 Morris ..... F25D 11/003 52/69
6,029,404 A * 2/2000 Lewis ..... E04B 9/06 52/2.11
7,882,659 B2 * 2/2011 Gyory ..... E04B 1/3444 52/79.5
8,650,806 B1 * 2/2014 Condie ..... E04H 3/08 52/79.5
2002/0116878 A1 * 8/2002 Ciotti ..... E04B 1/3442 52/64
2005/0122014 A1 * 6/2005 Bucher ..... E04B 1/3431 312/311
2008/0236055 A1 * 10/2008 Laprise ..... E04B 1/3444 52/64
2009/0217600 A1 * 9/2009 De Azambuja .... B65D 90/0006 52/79.5
2010/0192481 A1 * 8/2010 Shen ..... E04B 1/3444 52/79.5
2010/0269419 A1 * 10/2010 Gyory ..... E04B 1/3444 52/79.5
2012/0255240 A1 * 10/2012 Shen ..... E04B 1/34807 52/79.5
2013/0019913 A1 * 1/2013 Zadok ..... E04H 15/48 135/96
2013/0291449 A1 * 11/2013 Strickland ..... E04H 1/1205 52/79.5
2013/0305626 A1 * 11/2013 Strickland ..... E04B 1/34384 52/79.5
2014/0033619 A1 * 2/2014 Merchant ..... E04B 1/3442 52/71
2014/0150352 A1 * 6/2014 Lee ..... E04B 1/3444 52/2.22
2014/0202088 A1 * 7/2014 Nakajima ..... E04B 1/3444 52/79.5
2014/0202089 A1 * 7/2014 Nakajima ..... E04H 3/28 52/79.5
2014/0311052 A1 * 10/2014 Farmer ..... E04B 1/34357 52/79.5
2015/0315776 A1 * 11/2015 Duncan ..... A01K 3/00 52/66
2016/0069062 A1 * 3/2016 Dynon ..... E04B 1/34384 52/79.5
2017/0081867 A1 * 3/2017 Wasson ..... E04H 15/20
2017/0247184 A1 * 8/2017 Heskamp ..... B65D 90/008

FOREIGN PATENT DOCUMENTS

WO WO98/10954 A1 3/1998
WO WO2007/067153 A2 6/2007
WO WO2017/048777 A1 3/2017

* cited by examiner

EXPANDABLE CONTAINER SHELTER

This application is a National Stage Patent Application of PCT/SK2018/050009, filed on Jun. 26, 2018, which claims the benefit of priority to Slovakian Patent Application No. PUV50059-2017, filed on Jun. 27, 2017, the disclosures of all of which are incorporated by reference herein in their entireties.

TECHNICAL FIELD

The technical solution relates to expandable container shelters, particularly those which use transportation container as a container, for example made on the basis of intermodal container, also known as the ISO container, with lengths of 6 m and 12 m, 20 ft and 40 ft, respectively, More particularly, the technical solution relates to mentioned expandable container shelters, those which include parts for the construction of a shelter structure associated with this container that are connected to the container and stored in this container during its transportation and storage.

BACKGROUND ART

Extendable or expandable containers are standard product, mainly used for field applications as mobile hospital buildings, but also as accommodation, administrative or service units. In the case of extendable containers, lateral extension is approximately equal to the width of the container and as the container is usually extended to both sides, resulting object, including the container, is thereby substantially three times as wide as the container itself.

In the case of expandable containers, one or both of the longitudinal walls of the container are usually lowered, where the lowered wall at the same time serves as a floor for the shelter extension of the container. Such shelter is then formed by a cover, supported by a metal or inflatable structure. In this case, the lateral extension is approximately equal to the height of the container, and as the container is usually such expanded along both longitudinal sides, resulting shelter/building has thereby the width of the container substantially increased by double the height of the container.

Expandable container shelter having inflatable structure of the shelter is disclosed for example in WO2017/048777 A1.

With regard to the fact that the above mentioned solutions provide extension of existing container space practically only by double the width or the height of the container, if there is a requirement for larger place to be covered, as for example patient ward of a field hospital, separate tents or other shelters have to be connected to the container.

Creating larger space associated with the container using elements which forms a part of the container in its transportation or storage configuration is partially solved by WO2014/082104 A1. This document discloses a structure which includes a container which forms a housing and, mounted to the housing a plurality of walls which are pivotally interconnected and which are movable between a compact stored configuration and an extended operative configuration. These walls are being extended from longitudinal sides of the container by means of vertical hinging supports at the ends of the longitudinal sides of the container and vertical pivotal supports with which the walls are mutually connected. This solution allows for enclosing larger area, however, if this area is to be covered, said walls cannot be used as supporting for attaching a roof supports. Roof support, in this case a canvas, is provided in this solution in the form of a mast embedded in the ground and centrally positioned within the enclosure formed by the walls. Then, the canvas is stretched from the mast, and attached to the walls.

Object of this solution is to provide improved expandable container shelter, entirely transportable and storable in single container, which is able to provide maximum possible covered area when the container is expanded to its working configuration, without a need for adding external elements not comprised within this container. Proposed solution maximizes applicability of expandable container shelters.

DISCLOSURE OF INVENTION

Said object is fulfilled by expandable container shelter, particularly such that uses transportation container as a container, for example made on the basis of intermodal container, also known as the ISO container, with lengths of 6 m and 12 m, 20 ft and 40 ft, respectively, where this container comprises elements pivotally connected to the container in vertical mounts at the ends of longitudinal side of the container, provided for creating a structure designed for extending the inner space of the container to a shelter connected with this container at the longitudinal side of the container. Expandable container shelter according to this technical solution is characterized in that elements provided for creating the structure designed for extending the inner space of the container to the shelter connected with this container are at least on one longitudinal side of the container composed of one pair of supporting frames. The supporting frame comprises at least one horizontal beam and has length in the range up to dimension equal to inner length of the container. The shelter roof supports are then connected to said supporting frames. A connection of the roof supports to the supporting frame is of course understood also the connection of these supports to the supporting frame through other elements which can be present on this frame and can form a part of said supporting frame, such as various auxiliary beams, slats, shaped mounts, profile anchors and similar.

In order to improve and support positioning of the supporting frames, it is preferred that the supporting frame is at least at one point of its length from its pivotal mount in the container provided by a member for securing its horizontal position.

In order to create the shelter space enclosed from all sides, or to provide transversal reinforcement of the supporting frames, it is preferred that an auxiliary frame for providing transversal connection of the supporting frames in their opened position is mounted on the supporting frame in the area of its end opposite to its pivotal mount in the container. Then the shelter roof supports can be oriented in direction transversal to the length of the container, whereby they are connected to the auxiliary frame and the container. The auxiliary frame in its folded position can be inserted in the supporting frame in order to save space.

Supporting frames can be placed inside the container in one plane, whereby applies that maximal sum of lengths of the supporting frames is equal to the value of the inner length of the container; in other words maximal value of the sum of lengths of the supporting frames is equal to the value of the inner length of the container.

Further, the supporting frames can be placed inside the container in different planes, whereby maximal length of single supporting frame can be equal up to the value of the inner length of the container.

It is preferred, when the shelter roof supports are inflatable beams. Then, in regard of handling, it is further preferred when the inflatable beams are permanently connected to at least one supporting frame or to the container.

With regard to maintaining original dimensions of the container, particularly ISO container, that is important for managing of standardized transportation of containers, it is preferred when the supporting frame, the auxiliary frame, roof supports and roof are in transport or storage configuration of the container placed in the inner space of the container such that they do not project out over the outline of the container.

BRIEF DESCRIPTION OF DRAWINGS

The technical solution further described in examples of embodiments is depicted in attached drawings schematically showing on.

MODE(S) FOR CARRYING OUT THE INVENTION

Figure 1:
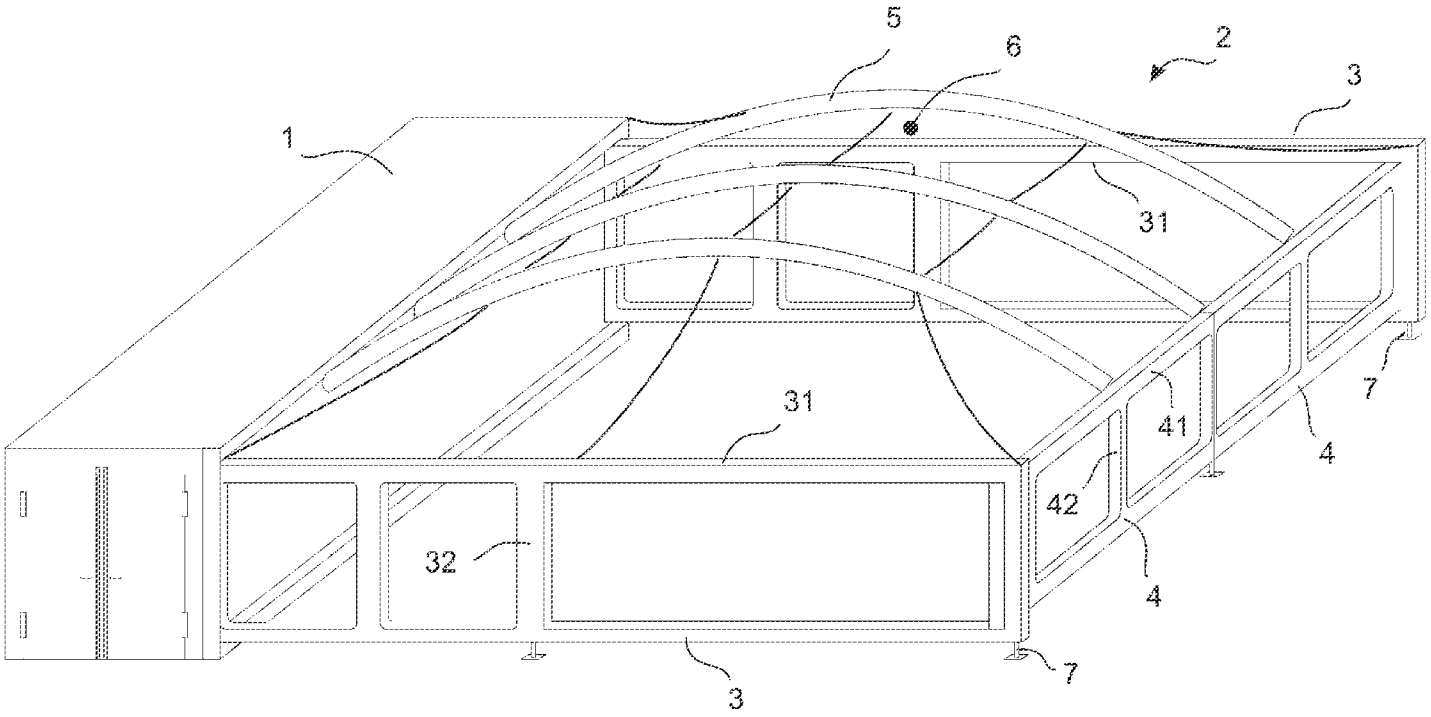
FIG. 1—expandable container shelter according to this technical solution in expanded configuration, with inflatable beams of shelter roof supports arranged in direction transversal to the length of the container.

Further described examples of embodiments of expandable container shelters according to this technical solution refer to FIG. 1 to FIG. 14. Said figures show shelters 2, or their parts on one side of a container 1, however, these figures, at the same time, illustrate also examples of embodiments with the shelters 2 at both sides of the container 1 because building of the shelter 2 at the other side of the container 1 is in fact analogous.

In general, embodiment of the expandable container shelter according to this technical solution, which is the most preferred in regard of maximal area covered and handling, comprises the container 1, two pairs of horizontally swivelling supporting frames 3 comprising auxiliary swivelling frames 4 and two roofs 6, attached on inflatable beams 5, where one pair of swivelling supporting frames 3 together with one roof 6 attached on the inflatable beams 5 is placed at one long side of the container 1, and the other pair of the swivelling frames 3 together with the other roof 6 attached on the inflatable beams 5 is placed at the opposite long side of the container 1. In this way, symmetrical, sufficiently rigid structure composed of the container 1 and two shelters 2 placed by long sides of said container 1 is created.

Further, generally the most preferred position of opened supporting frames 3 is mutually parallel and perpendicular to the container 1. However, it is possible also to create an object of different shape, for example trapezoidal or rhombic, by applying different lengths of the supporting frames 3.

Figure 2:
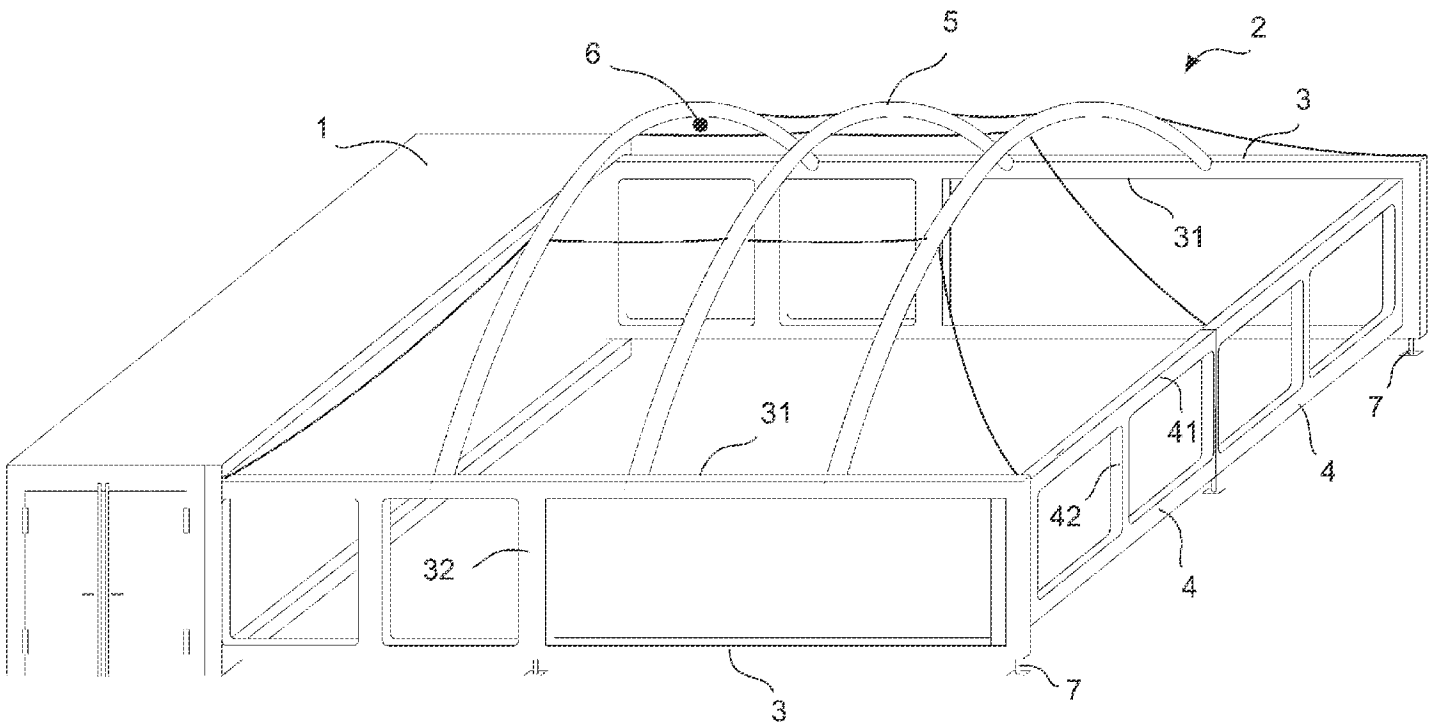
FIG. 2—expandable container shelter according to this technical solution in expanded configuration, with inflatable beams of shelter roof supports arranged in direction accordant to the length of the container.

The first example of embodiment of the expanded container shelter according to this technical solution described hereinafter, is shown in FIG. 1 and FIG. 2.

Figure 9:
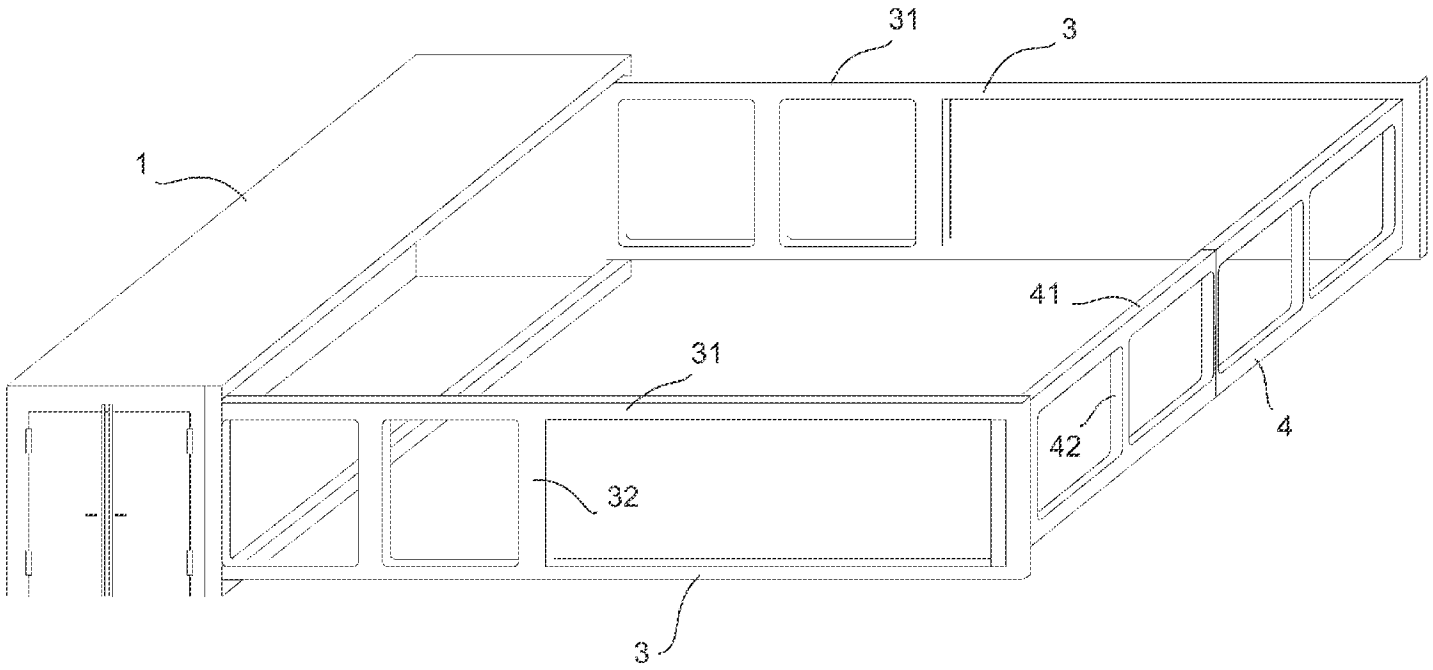
FIG. 9—particular structure variant of the supporting frames and the auxiliary frames of the expandable container shelter according to this technical solution with vertically reinforced horizontal beams.
Figure 10:
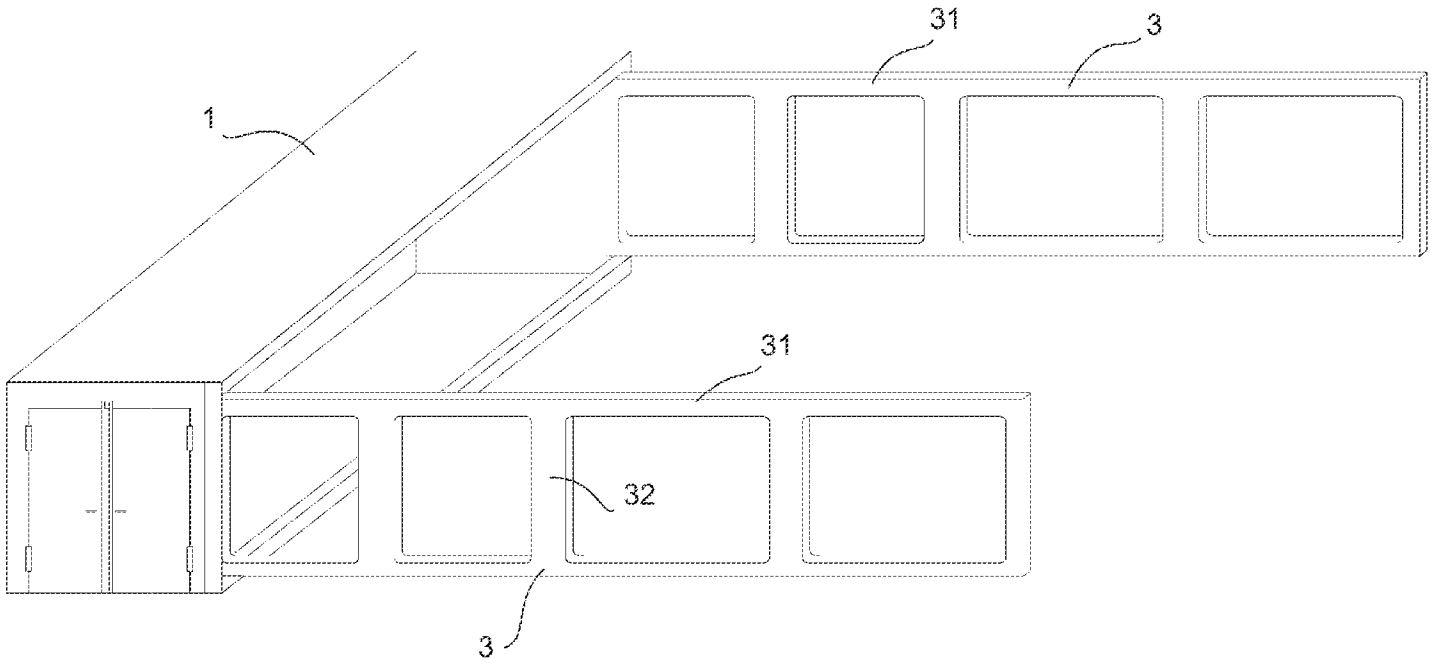
FIG. 10—particular structure variant of the supporting frames of the expandable container shelter according to this technical solution with vertically reinforced horizontal beams.
Figure 11:
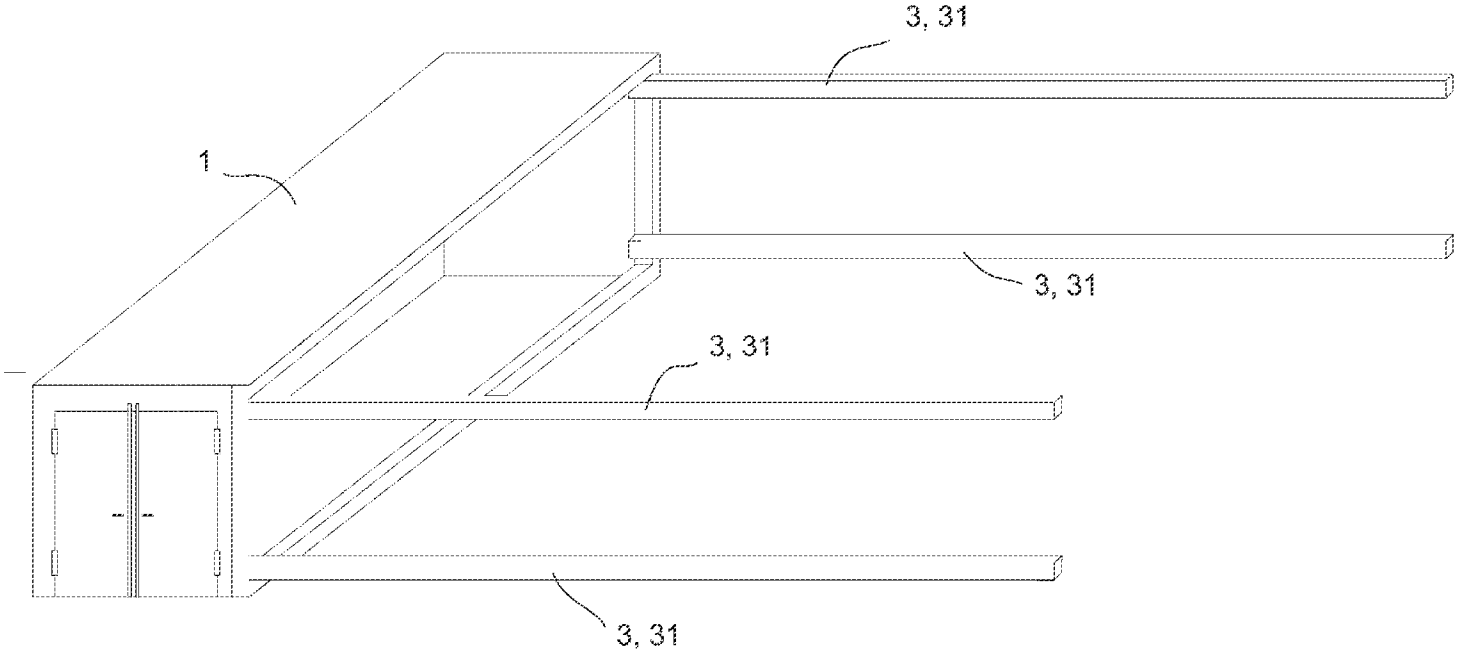
FIG. 11—particular structure variant of the supporting frames of the expandable container shelter according to this technical solution with pair of single horizontal beams at one supporting frame.

Pair of supporting frames 3 is mounted in vertical pivotal mounts on the opposite ends of the container 1 on each longitudinal side of the container 1. Specifically, each one of the supporting frames 3 is with its one end mounted in one pivotal mount. Each supporting frame 3 comprises a pair of horizontal beams 31 with vertical reinforcements 32 and auxiliary frames 4 at free ends of the supporting frames 3. These auxiliary frames 4 have in this example similar structure as supporting frames 3, thus comprise a pair of horizontal beams 41 with vertical reinforcements 42. This particular arrangement of supporting frames 3 and auxiliary frames 4 is shown in FIG. 9.

In closed configuration, the supporting frames 3 are placed inside the container 1 in different planes and thus maximal length of one supporting frame 3 can practically be equal to dimension of the inner length of the container 1. The auxiliary frame 4 of the supporting frame 3 is in this example provided such that it does not project out over the thickness of the supporting frame 3. This is advantageous in regard of space saving when the supporting frame 3 is folded. The auxiliary frame 4 is in this example pivotally mounted in the supporting frame 3 by its one edge. Length of the auxiliary frame 4 is in this example equal to half of the distance between the supporting frames 3 in opened working position, i.e. when unfolded supporting frames 3 are parallel.

Figure 6:
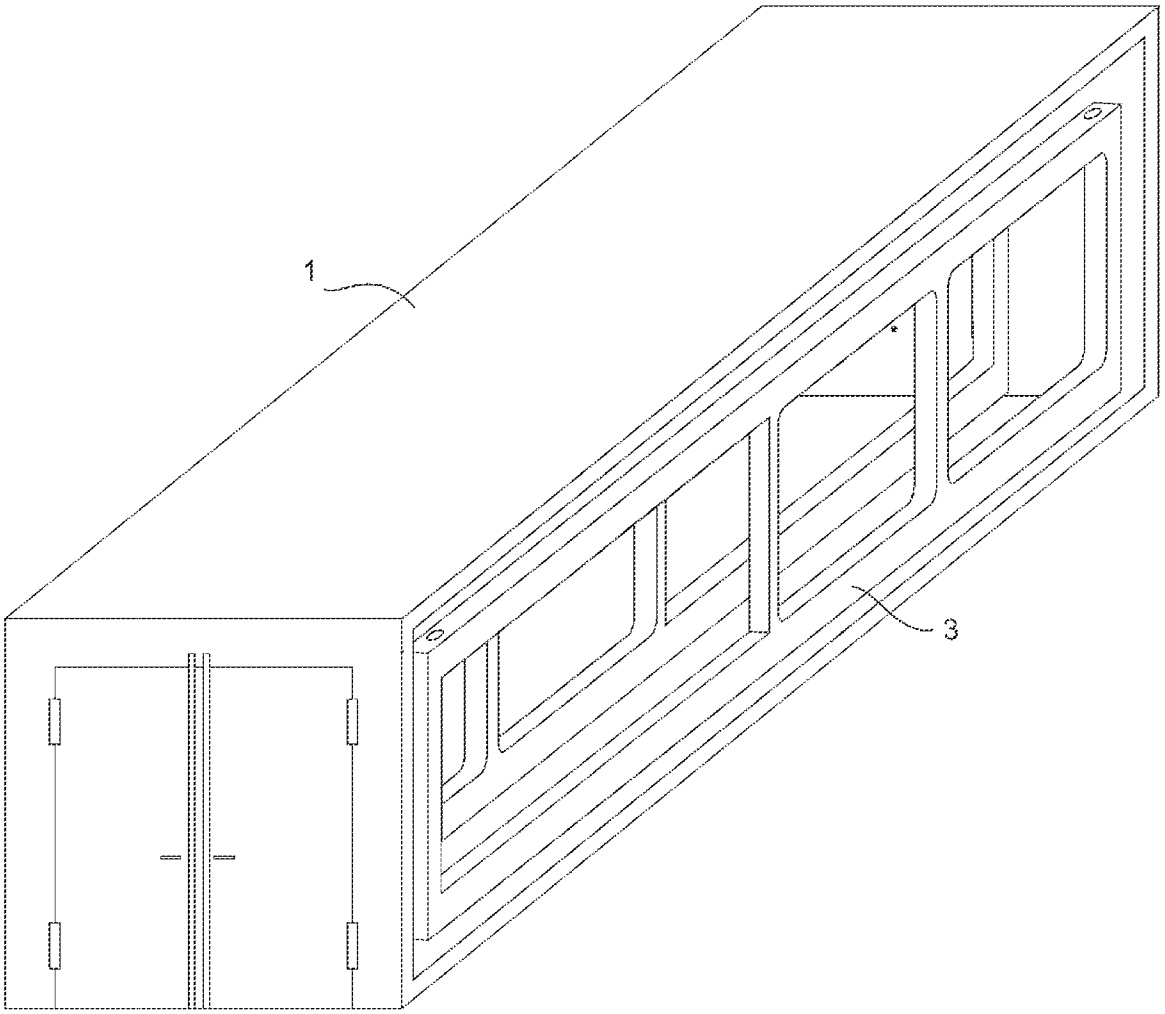
FIG. 6—expandable container shelter according to this technical solution in closed configuration.
Figure 7:
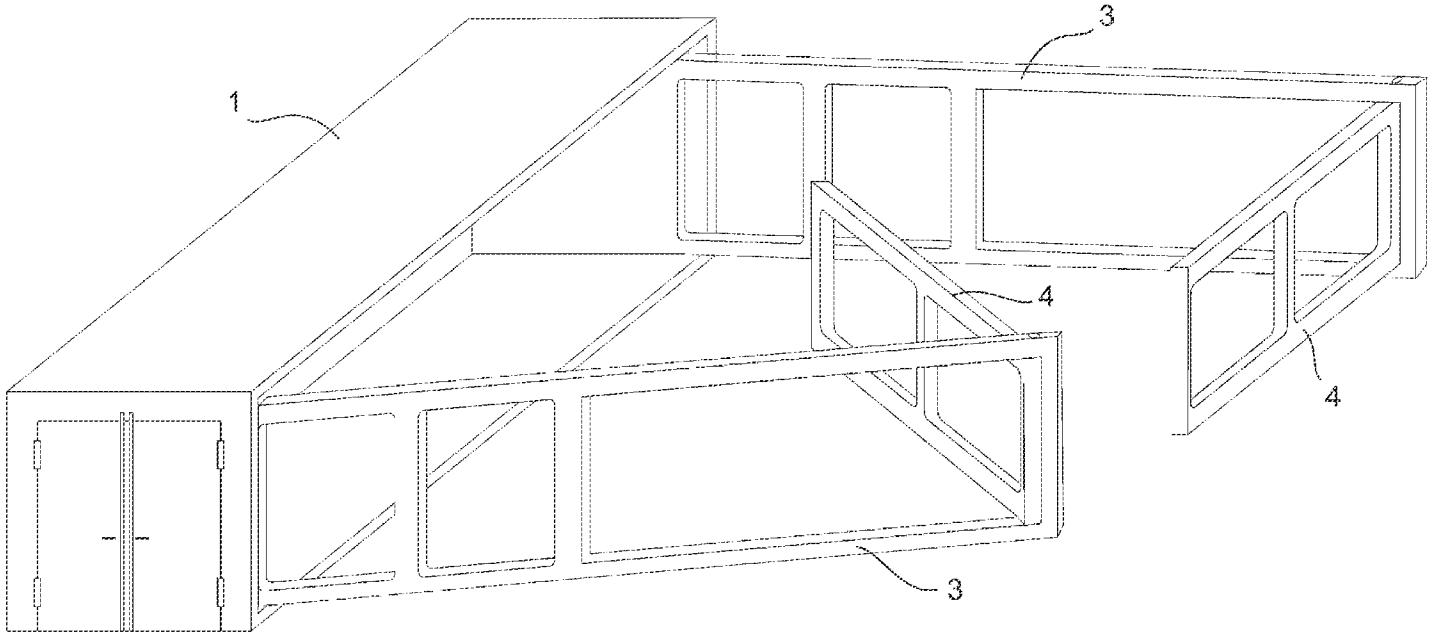
FIG. 7—expandable container shelter according to this technical solution in position of partially unfolded supporting frames and auxiliary frames, thus in the phase of unfolding the shelter from the container.
Figure 8:
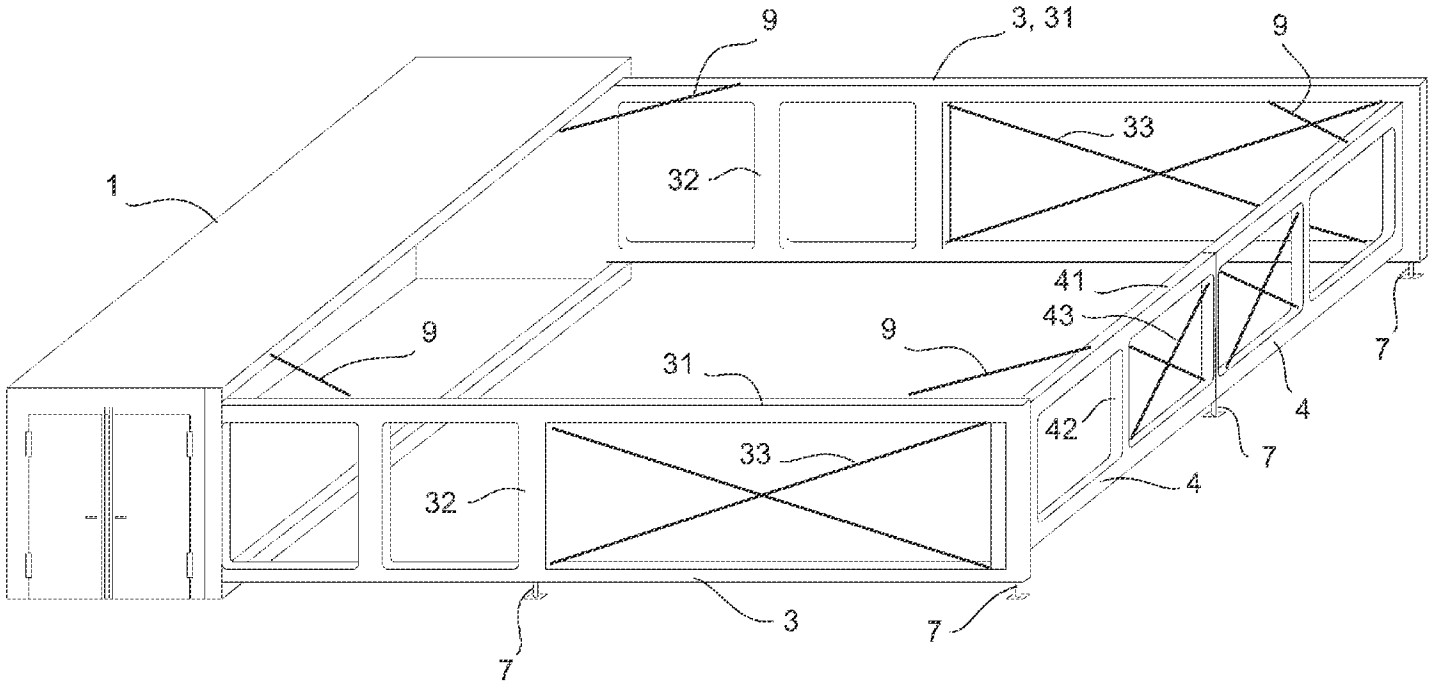
FIG. 8—expandable container shelter according to this technical solution in fully expanded configuration of the supporting frames and the auxiliary frames, thus in the phase before installation of a roof.

After setting up the container 1 at desired place, supporting frames 3 are one after the other opened. Afterwards, the auxiliary frames 4 are unfolded from these frames 3. It is preferred to secure opened supporting frames 3, and if appropriate, also the auxiliary frames 4 in their pivotal mounts. It is possible the structure such created further preferably stabilize by connecting the ends of the auxiliary frames 4 with members 7 for securing of horizontal position of the supporting frames 3 and/or the auxiliary frames 4, which can be commonly used, preferably height-adjustable, supports, legs, baseplates, and similar, or also wheels, runners and similar, which can help even during the step of unfolding of the frames 3, 4. This structure, if necessary, can be further strengthened also using corner reinforcements 9 which can stabilize the frames 3, 4 against each other, or the supporting frames 3 against the container 1, or diagonal reinforcements 33, 43 which reinforce the frames 3, 4 individually. Said steps are schematically shown in FIGS. 6, 7 and 8. Sides of the frames 3, 4 can be preferably in advance covered by solid or flexible material, thereby preparing walls of future object and saving time for installation.

Afterwards, said structure is ready for installation of the roof 6. The roof 6 comprises, in this example, beam 5 which are at one end connected to the container 1 and at the other end to the auxiliary frames 4, as shown in FIG. 1, or the beams 5 are connected to opposite supporting frames 3, as shown in FIG. 2. In this example of embodiment, roof 6 supports 5 are arcuate inflatable beams. The roof 6 is conventionally of canvas type, made of flexible material, or combination of flexible and not flexible material, preferably impregnated or coated fabric.

Making use of arcuate inflatable beams as roof 6 supports 5 is very advantageous due to following reasons.

The arcuate inflatable beam 5 is easily transportable, folded or rolled, together with the shelter 2 roof 6. The beam 5 can be permanently connected with material of the roof 6. Folded or rolled roof 6 including deflated beams 5 can be stored in the container 1 separately.

Preferably it is however possible to connect at least one side of the roof 6 together with one side of the roof beams 5 permanently to the container 1, in the case the beams 5 are arranged in direction transversal to the length of the container 1; or the beams 5 can be permanently connected to at least one supporting frame 3 in the case when the beams 5 are arranged in direction accordant to the length of the container 1.

During transportation, folded roofs 6 together with deflated beams 5 are contained inside the container 1. One side of deflated beams 5 is then preferably suspended under a ceiling of the container 1 in holders, for example in guiding grooves, to be possible for the ends of the beams to be easily moved to the edge of the container 1, i.e. to working position, when the shelter 2 roof 6 is being assembled.

Remaining part of the beams 5 and the roofs 6 is then hanging folded under the ceiling of the container 1, or this part of the beams 5 and roofs 6 is lying folded at the bottom of the container 1 and only a part of said beams 5 and roofs 6 corresponding approximately to the height of the container is hanging. It is preferred to suspend the roofs 6 completely, because a space is then left at the bottom of the container 1 for storing of other possible parts of the shelters 2, for example floor, or if necessary auxiliary inflatable tent, as well as technical equipment such as air conditioning unit, power generators or air compressor that can be used also for inflating the beams 5. Said arrangement is not shown in figures, as it is sufficiently clearly described and conceivable.

The roofs 6 such placed and accessories are during transportation thus practically situated in central part of the container 1 and closed by pair of supporting frames 3 from both sides. It is preferred, in order to maintain standard dimensions of the container 1, especially in the case of ISO container, when outer side of the outer supporting frame 3 does not project out over the outline of the container 1.

After the roof 6 with beams 5 is unfolded, free end of the beams 5 is attached, with known anchoring members, to the opposite side of the structure, i.e. to the auxiliary frames 4, or to the opposite supporting frame 3. Afterwards, the roof 6 is attached on the periphery with commonly available attaching means used for canvas type roofs, usually to the edges of the shelter 2 structure, which are in this case the container 1, supporting frames 3 and auxiliary frames 4. Possible ways of attaching of roof 6 periphery vary upon requirements for water-proofing, air-proofing, time of installation and other conditions, while their embodiment, if it is over the entire periphery, does not influence functionality of the assembly itself.

In the case, a floor is also a part of the container 1, preferably coiled on a roll inside the container 1, it is unrolled as the first to protect the roof 6 against dirtying of its inner side. Afterwards, the roof 6 is unfolded on the floor and further work continues as described in preceding paragraph.

Roof beams 5 are then inflated, thereby stretching the roof and strengthening the entire structure of the shelter 2. Inflating the beams 5 is carried out in known ways form known sources of compressed air, for example by means of standardized compressor hoses and connectors from a compressor or air cylinder, if appropriate by means of electric blower and similar.

It is not necessary, however appropriate for the sake of thoroughness, to mention that when building the shelters 2 on both sides of the container 1, it is advisable to at least open the supporting frames 3 from the container 1 on both sides of the container 1 simultaneously due to optimal mass balance.

Short sides of the container 1, that is front and rear walls, can be provided by swivelling wall serving as access floor, onto which an inflatable tent can be folded during transportation, or they can be provided by regular access doors, or technical equipment can be placed onto one of the sides, either permanently placed outside on holders, or during transportation, placed inside the container 1 and closed by the wall of the transportation container.

Figure 3:
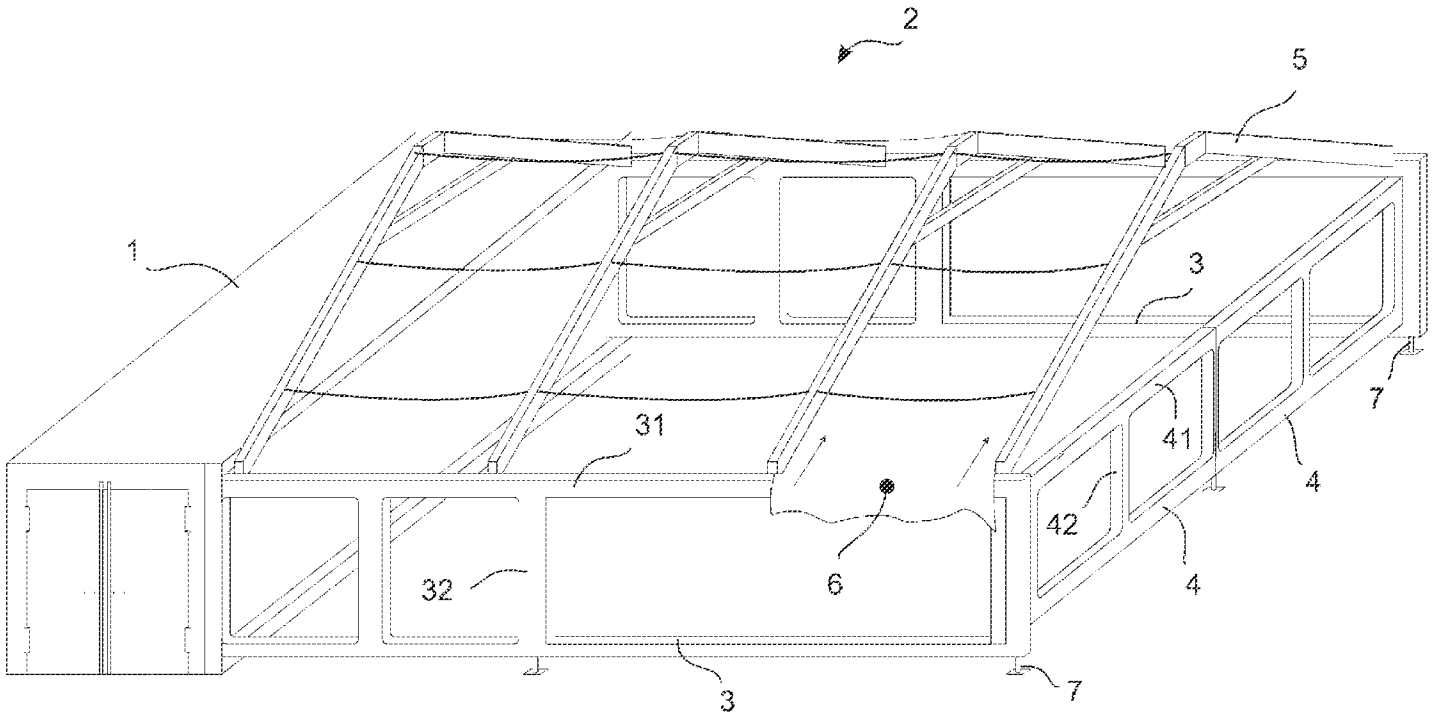
FIG. 3—expandable container shelter according, to this technical solution in expanded configuration, with shelter roof supports connected to the supporting frames, with a roof placed between said roof supports by means of Keder slid into a luff groove in the roof supports.
Figure 4:
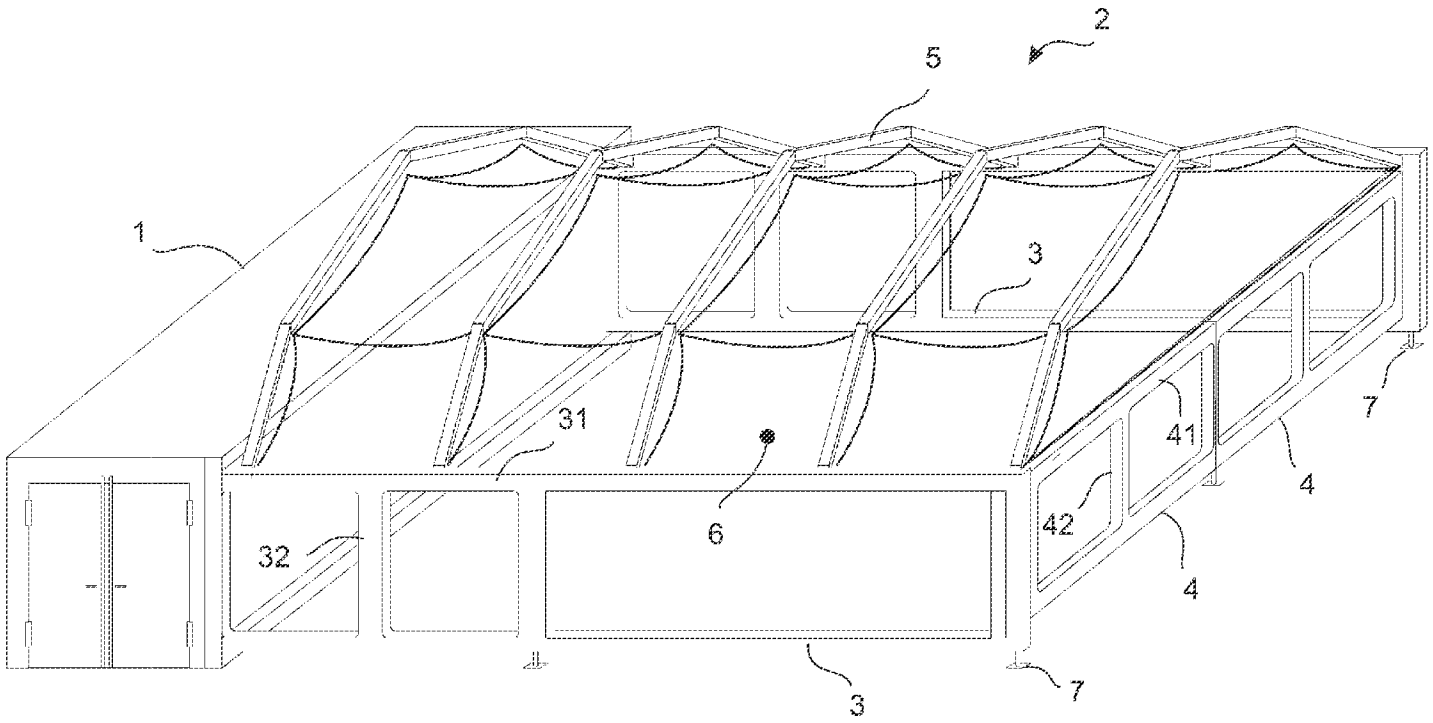
FIG. 4—expandable container shelter according to this technical solution in expanded configuration, with shelter roof supports connected to the supporting frames, with a roof suspended under said roof supports.

Another example of embodiment of expandable container shelter according to this technical solution described hereinafter is shown in FIG. 3 and FIG. 4. In this example of embodiment, the bottom structure of the shelter 2 composed basically of the container 1, supporting frames 3 and auxiliary frames 4, is substantially identical with that as described above in the example of embodiment according to FIG. 1 and FIG. 2. Instead of inflatable beam 5, the support 5 is provided as solid beam. Various knows forms of arcuate, bent or straight beams, made of metal, composite, wood, or other suitable material can be used as the solid beam 5.

In the case of use of solid beams 5, arcuate or bent, which upper edge is longer than roof span, that is the distance between longitudinal edge of the container 1 and auxiliary frames 4, or between the supporting frames 3, i.e. arcutate or bent beams, it is expected that material of the roof 6 folded or rolled separately without the beams 5.

During installation of the roof 6, the beams 5 are attached to the bottom structure of the shelter 2 and the roof 6 is stretched upon their surface, or in suspended configuration, the roof 6 is pulled to the beam 5, or the beams 5 are installed from the underside as the last ones and the entire roof 6 is stretched by pushing the beams 5 into their given position on the bottom structure of the shelter 2. Also, as schematically shown in FIG. 3, the roof 6 can be installed between the beams 5 by means of Keder slid into a luff groove provided in the beams 5. These mentioned ways of installation of the roof 6 can also be similarly used with the inflatable beams 5.

Figure 5:
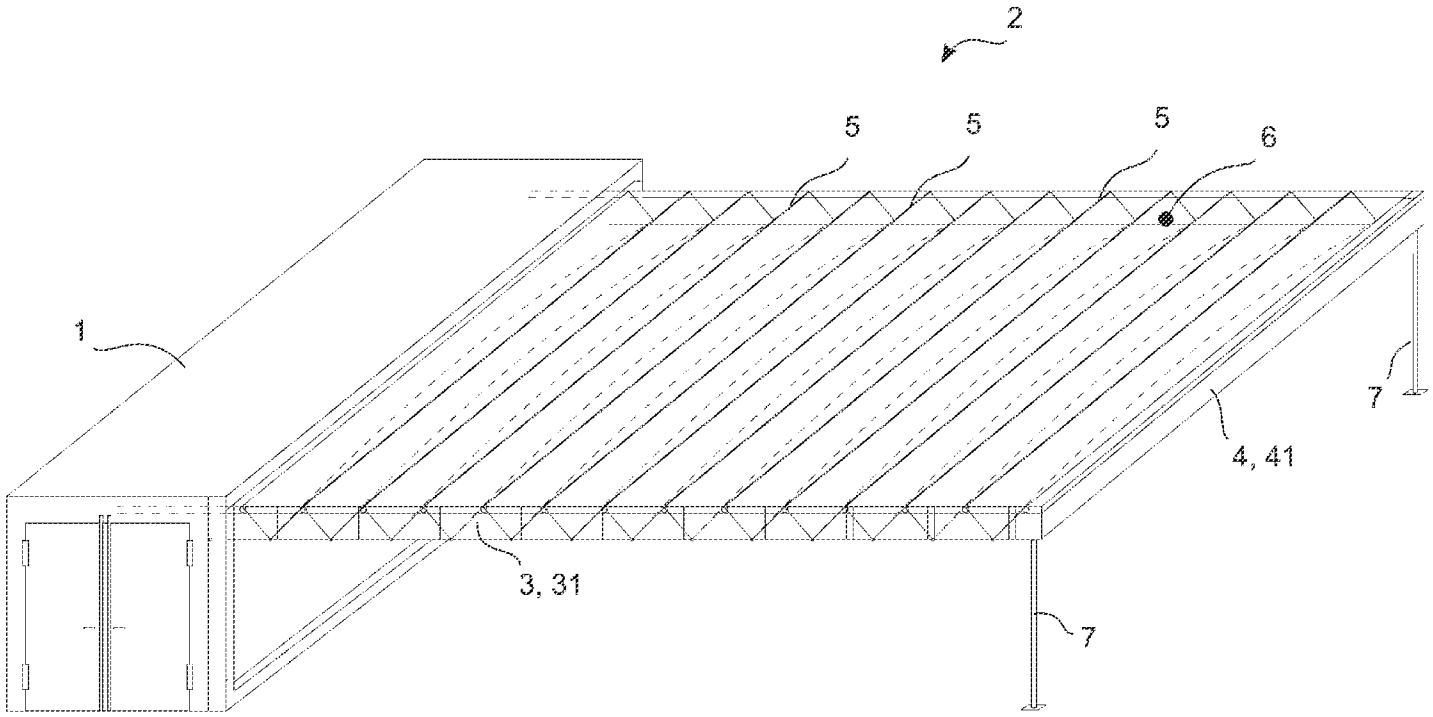
FIG. 5 expandable container shelter according to this technical solution in expanded configuration, with folding roof with solid bars sliding over the length of the supporting frames.

Another example of embodiment of expandable container shelter according to this technical solution described hereinafter is shown in FIG. 5

In this example, straight beams 5 are used whose upper edge has approximately the same length as is the roof 6 span, that is in this example the distance between the supporting frames 3. The roof 6 is permanently attached to the beams 5 and is stored inside the container in folded or so called accordion shape. In such case, installation would be most preferably carried out by unfolding the roof 6 by means of a guiding rail or groove in the supporting frames 3 guiding the ends of straight beams 5.

Figure 12:
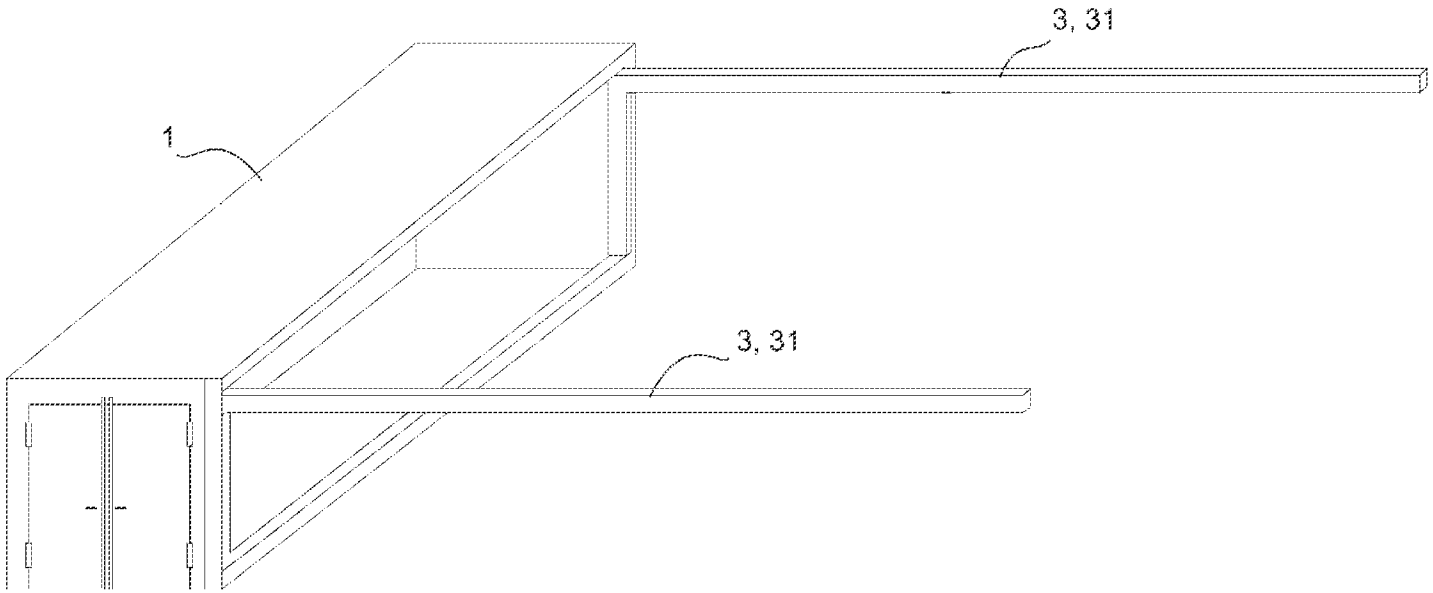
FIG. 12—particular structure variant of the supporting frames of the expandable container shelter according to this technical solution with a single horizontal beam at one supporting frame.

In this example of embodiment, the supporting frames 3 can be shaped as shown in FIG. 12. It is preferred then, in order to increase rigidity of such structure to provide the supporting frames 3 at their end with members 7 for securing their horizontal position, e.g. in the form of legs.

Further, in this example of embodiment according to FIG. 5, in the case of connecting, of free ends of the supporting frames 3 with the auxiliary frame 4 at least in the form of horizontal beam 41, the roof supports 5 can be arranged parallel to the supporting frame 3. Then, the roof 6 would unfold by means of guiding rail or groove on the container 1 and the auxiliary frame 4.

Figure 13:
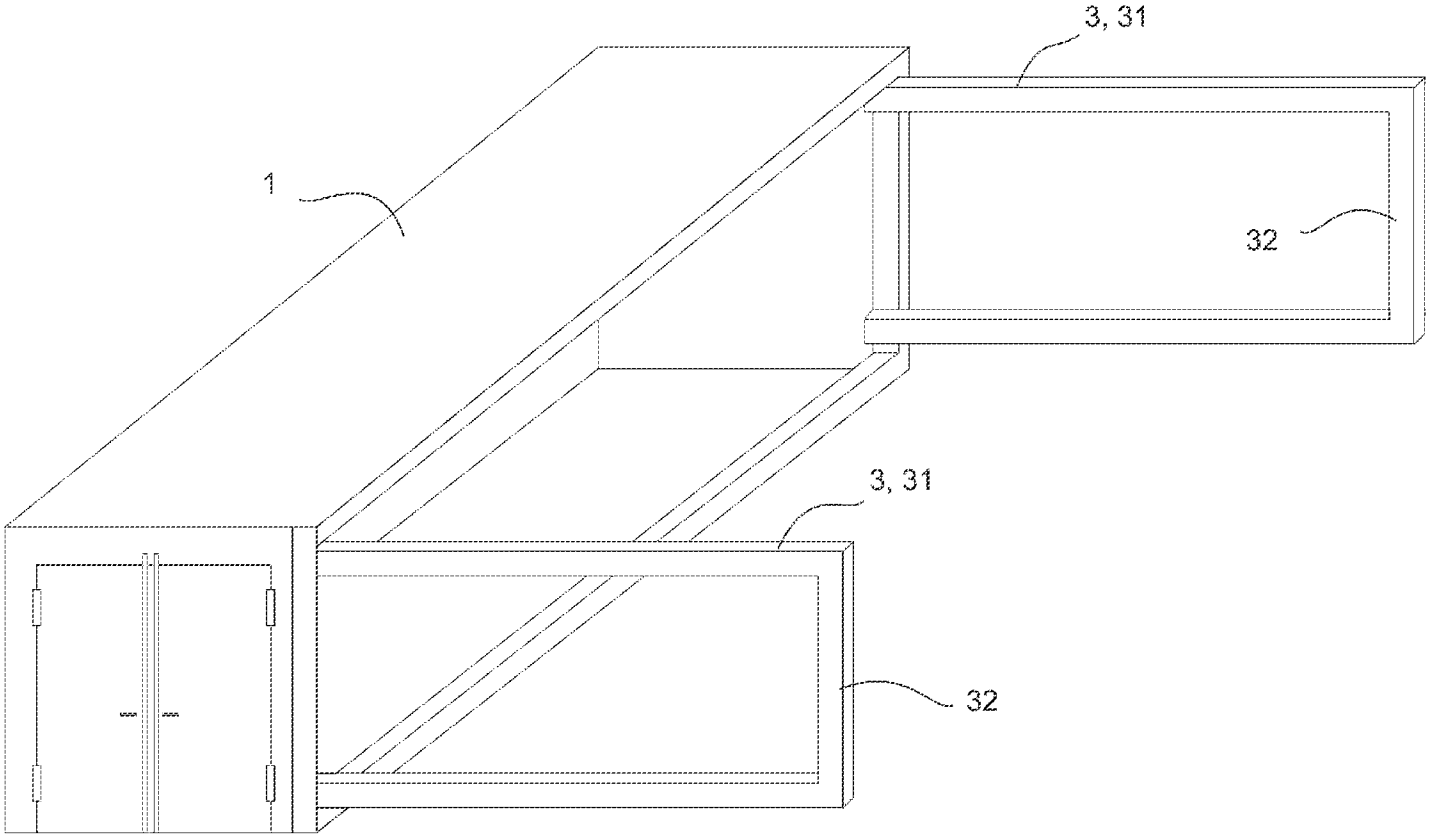
FIG. 13—particular structure variant of the supporting frames of the expandable container shelter according to this technical solution for placing the supporting frames into the container in one plane, where both the supporting frames have the same length.
Figure 14:
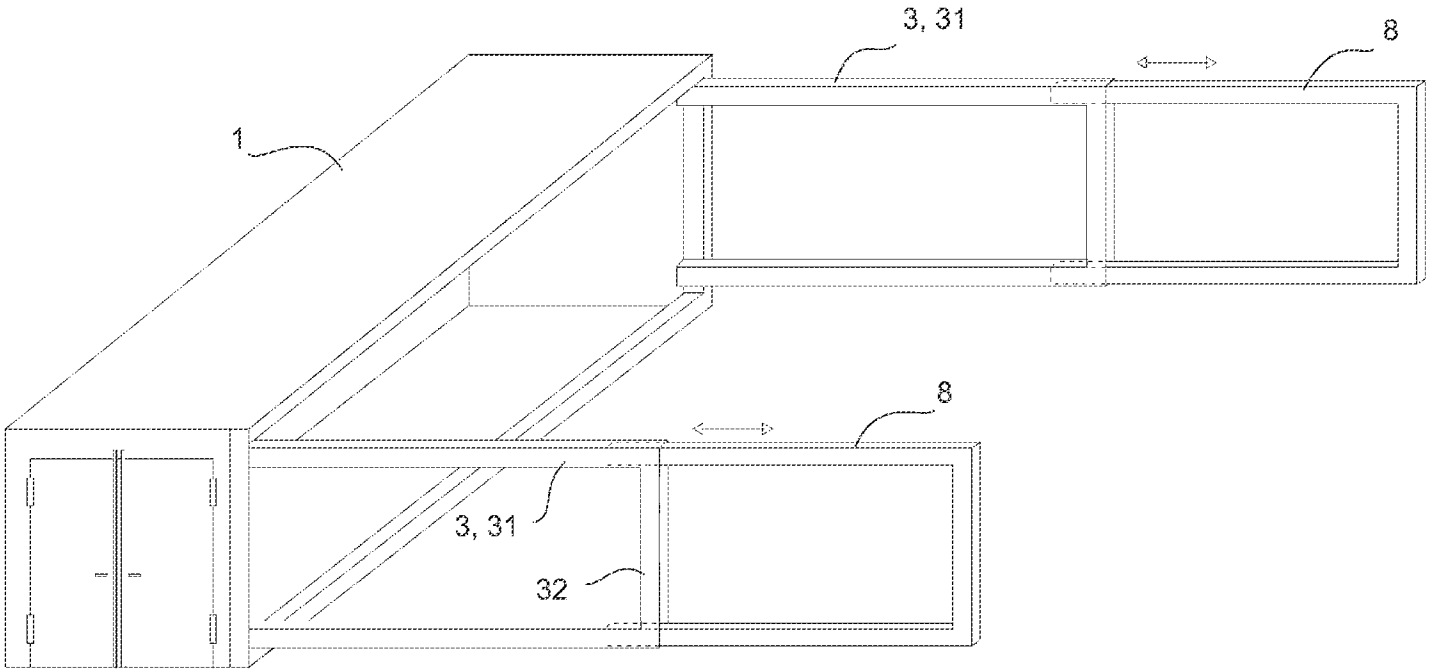
FIG. 14—particular structure variant of the supporting frames of the expandable container shelter according to this technical solution for placing the supporting frames into the container in one plane, where both the supporting frames have the same length, with elongating parts for increasing the length after unfolding the supporting frames from the container.

Example of embodiment of expandable container shelter according to this technical solution, where the supporting frames 3 are placed in closed configuration inside the container 1 in one plane and maximal value of the sum of lengths of the supporting frames 3 is equal to the value of the inner length of the container 1, is shown in FIG. 13 and FIG. 14.

In the example of embodiment shown, length of the supporting frame 3 is equal to the half of the inner length of the container 1. The supporting frames 3 can be provided as extendable. It means that sliding extension part 8 is slid in the supporting frame 3, which, after the supporting frame 3 is opened, slides out and extends the supporting frame 3 by the length of this extension part 8. This particular embodiment is shown in FIG. 14.

Above described examples of embodiments shown on attached drawings do not exhaust all possibilities of embodiments of expandable container shelter according to this technical solution. Other embodiments of expandable container shelter within the idea of this technical solution and in the scope of the claims can be provided by further combining described parts and their arrangements. Such embodiments can be provided upon requirements for placement or use of the expandable container shelter in particular real-life situations.

The invention claimed is:

1. An expandable container shelter comprising:

a container defining a longitudinal side as a rigid sidewall of the expandable container shelter and defining an inner length extending along the longitudinal side;

a plurality of elements pivotally and vertically connected to the container at opposite ends of the longitudinal side of the container as a plurality of expandable sidewalls extending from the container, the plurality of elements being provided for creating a structure designed for extending an inner space of the container at the longitudinal side of the container, wherein the plurality of elements comprise a pair of supporting frames, wherein at least one supporting frame of the pair of supporting frames comprises at least one solid horizontal beam, wherein the at least one supporting frame has a length that is greater than or equal to one half the inner length of the container and less than or equal to the inner length of the container; and a plurality of shelter roof supports connected to the pair of supporting frames, wherein the plurality of shelter roof supports are inflatable beams connected to the at least one solid horizontal beam, wherein each inflatable beam of the plurality of shelter roof supports extends between a first end and a second end, the first end being permanently connected to the plurality of elements or to the container, the second end being selectively attachable to the at least one solid horizontal beam, and wherein each inflatable beam of the plurality of shelter roof supports is completely suspendable under a ceiling of the container apart from a floor of the container to define a space at a bottom of the container.

2. The expandable container shelter according to claim 1, wherein the length of at least one supporting frame extends from the container to a member for securing a horizontal position of the at least one supporting frame.

3. The expandable container shelter according to claim 1, further comprising an auxiliary frame for providing transversal connection of the pair of supporting frames in an opened position, the auxiliary frame being mounted on the at least one supporting frame at an opposite end from the container.

4. The expandable container shelter according to claim 3, wherein the plurality of shelter roof supports are connected to the auxiliary frame and the container.

5. The expandable container shelter according to claim 3, wherein the auxiliary frame is foldable and insertable into the at least one supporting frame.

6. The expandable container shelter according to claim 1, wherein the plurality of supporting frames are placed inside the container in one plane and a maximum value of the sum of lengths of the supporting frames is equal to a value of the inner length of the container.

7. The expandable container shelter according to claim 1, wherein the pair of supporting frames are placed inside the container in different planes and a maximal length of the at least one supporting frame is equal to a value of the inner length of the container.

8. The expandable container shelter according to claim 1, wherein the pair of supporting frames, an auxiliary frame, the plurality of shelter roof supports, and a roof in a storage configuration of the container are in the inner space of the container, whereby the pair of supporting frames, the auxiliary frame, the plurality of shelter roof supports, and the roof do not project out over the outline of the container.

9. The expandable container shelter comprising:

a container defining a longitudinal side as a rigid sidewall of the expandable container shelter;

a pair of supporting frames comprising a first support frame and a second support frame, each supporting frame of the pair of supporting frames being connected to the container in independent vertical pivotal connection at opposite ends of the longitudinal side of the container as a plurality of expandable sidewalls extending from the container, each supporting frame of the pair of supporting frames comprising a discrete solid horizontal beam that is pivotable with a corresponding frame of the pair of supporting frames; and a plurality of shelter roof supports extending longitudinally between the pair of supporting frames, wherein each shelter roof support comprises an inflatable beam extending between a first end and a second end, the first end being a fixed end that is permanently connected to the first support frame and the second end being selectively attachable to the second support frame, and wherein each inflatable beam of the plurality of shelter roof supports is completely suspendable under a ceiling of the container apart from a floor of the container to define a space at a bottom of the container.

10. The expandable container shelter of claim 9, wherein the container defines an inner length along the longitudinal side, and wherein the each supporting frame of the pair of supporting frames has a length that is greater than or equal to one half the inner length of the container and less than or equal to the inner length of the container.

11. An expandable container shelter comprising:

a container defining a longitudinal side and defining an inner length extending along the longitudinal side;

a plurality of elements pivotally and vertically connected to the container at opposite ends of the longitudinal side of the container, the plurality of elements being provided for creating a structure designed for extending an inner space of the container at the longitudinal side of the container, wherein the plurality of elements comprise a pair of supporting frames, wherein at least one supporting frame of the pair of supporting frames comprises at least one solid horizontal beam, wherein the at least one supporting frame has a length that is greater than or equal to one half the inner length of the container and less than or equal to the inner length of the container;

one or more guiding rails or grooves defined on the horizontal beam; and a plurality of shelter roof supports connected to the pair of supporting frames, wherein the plurality of shelter roof supports are inflatable beams each extending between a first end and a second end, the first end being permanently connected to the one or more guiding rails or grooves, the second end being selectively attachable to the second support frame, and wherein each inflatable beam of the plurality of shelter roof supports is completely suspendable under a ceiling of the container apart from a floor of the container to define a space at a bottom of the container.

12. The expandable container shelter according to claim 11, wherein the length of at least one supporting frame extends from the container to a member for securing a horizontal position of the at least one supporting frame.

13. The expandable container shelter according to claim 11, further comprising an auxiliary frame for providing transversal connection of the pair of supporting frames in an opened position, the auxiliary frame being mounted on the at least one supporting frame at an opposite end from the container.

14. The expandable container shelter according to claim 13, wherein the plurality of shelter roof supports are connected to the auxiliary frame and the container.

15. The expandable container shelter according to claim 13, wherein the auxiliary frame is foldable and insertable into the at least one supporting frame.

16. The expandable container shelter according to claim 11, wherein the plurality of supporting frames are placed inside the container in one plane and a maximum value of the sum of lengths of the supporting frames is equal to a value of the inner length of the container.

17. The expandable container shelter according to claim 11, wherein the pair of supporting frames are placed inside the container in different planes and a maximal length of the at least one supporting frame is equal to a value of the inner length of the container.

18. The expandable container shelter according to claim 11, wherein the pair of supporting frames, an auxiliary frame, the plurality of shelter roof supports, and a roof in a storage configuration of the container are in the inner space of the container, whereby the pair of supporting frames, the auxiliary frame, the plurality of shelter roof supports, and the roof do not project out over the outline of the container.

* * * * *